United States Patent [19]

Elenga et al.

[11] 4,176,310

[45] Nov. 27, 1979

[54] DEVICE COMPRISING A TRANSFORMER FOR STEP-WISE VARYING VOLTAGES

[75] Inventors: Cornelis W. Elenga; Pieter van Dijk; Alfred J. van der Zwart, all of Eindhoven, Netherlands

[73] Assignee: U.S. Philips Corporation, New York, N.Y.

[21] Appl. No.: 885,635

[22] Filed: Mar. 13, 1978

[30] Foreign Application Priority Data

Mar. 30, 1977 [NL] Netherlands ..... 7703425

[51] Int. Cl.[2] ..... G05F 3/00

[52] U.S. Cl. ..... 323/7; 250/421; 315/283; 363/39

[58] Field of Search ..... 250/402, 409, 418, 421; 315/246, 258, 283; 323/7, 74; 361/35; 363/39, 40, 43, 45, 46, 47, 48, 54, 56, 96, 125, 126

[56] References Cited

U.S. PATENT DOCUMENTS 3,099,789 7/1963 Perrins ..... 323/7

*Primary Examiner*—William M. Shoop

*Attorney, Agent, or Firm*—Thomas A. Briody; Bernard Franzblau

[57] ABSTRACT

A device comprising a transformer for step-wise varying voltages in which, in order to prevent undesired oscillations in the transformer, a circuit is included in the connection lead thereof, said circuit comprising at least one inductive element and at least one rectifying element. The inductance of the inductive element is a number of times higher than the leakage inductance of the transformer. The circuit has the property that the current through the inductive element (elements) does not change its direction when the sign of the voltage between its connection terminals is reversed.

10 Claims, 9 Drawing Figures

DEVICE COMPRISING A TRANSFORMER FOR STEP-WISE VARYING VOLTAGES

The invention relates to a device comprising a transformer for step-wise varying voltages.

A problem encountered in devices of this kind consists in that a step-wise varying voltage (for example, a single voltage step or a squarewave voltage) which is applied to the primary side of the transformer causes a damped oscillation on the secondary side. This is mainly due to the leakage inductance and the parasitic capacitance of the transformer.

An object of the invention is to improve a device of the described kind so that this problem is substantially eliminated. To this end, the device in accordance with the invention is characterized in that at least one inductive element is included in a connection lead on the primary side of the transformer (i.e. in series with the primary winding across a pair of input terminals), the inductance of said element being a number of times higher than the leakage inductance of the transformer, said inductive element being connected to one or more rectifying elements so that a circuit is formed which has the property that the current through the inductive element (elements) does not reverse its direction when the sign (i.e. polarity) of the voltage between the connection terminals of this circuit is reversed.

An embodiment of the device in accordance with the invention, which not only eliminates the described problem for a single voltage step but also for a squarewave voltage, is characterized in that the circuit conducts the current in both directions substantially equally well.

Figure 1:
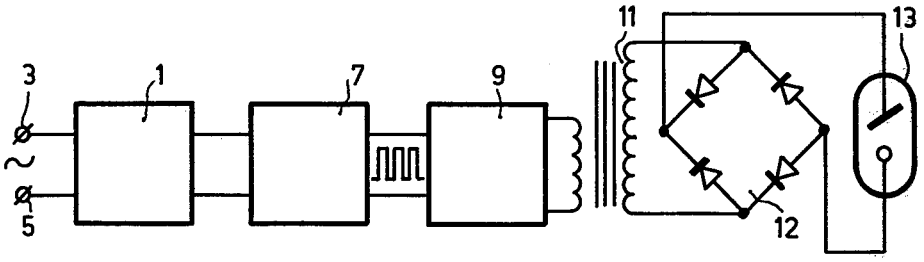
Figure 2:
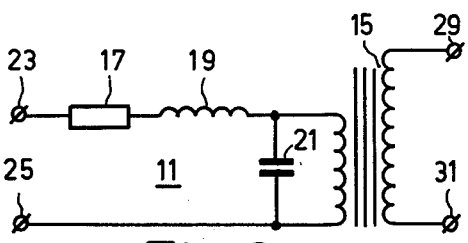
Figure 3:
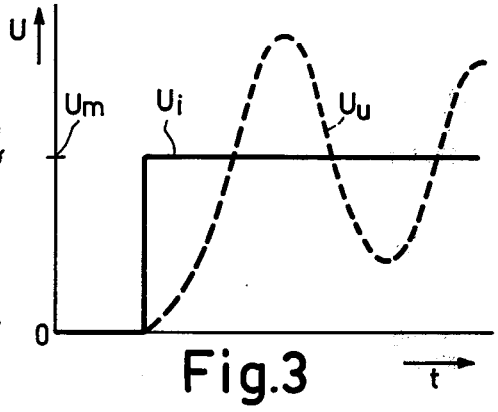
Figure 5:
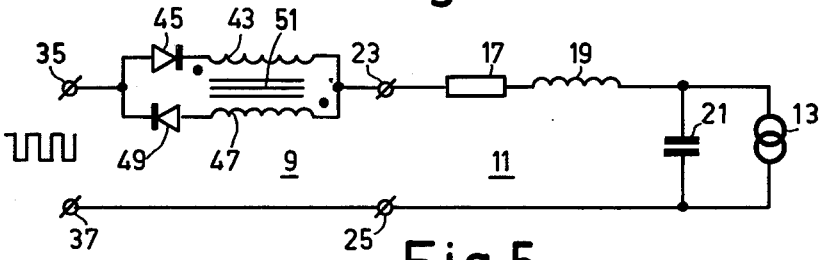
Figure 6:
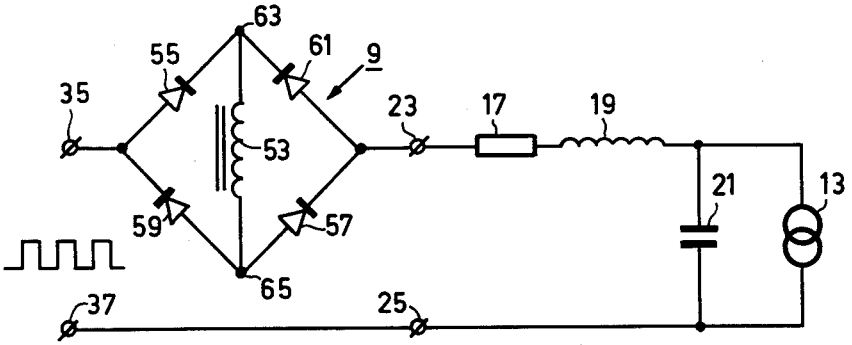
Figure 7:
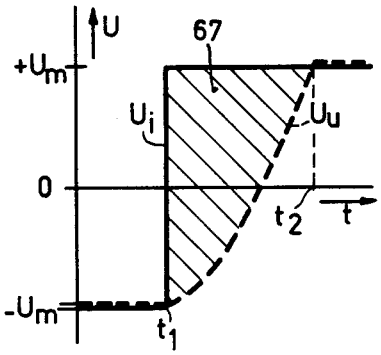
Figure 8:
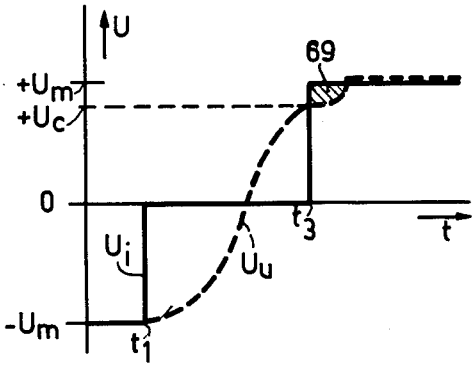
Figure 9:
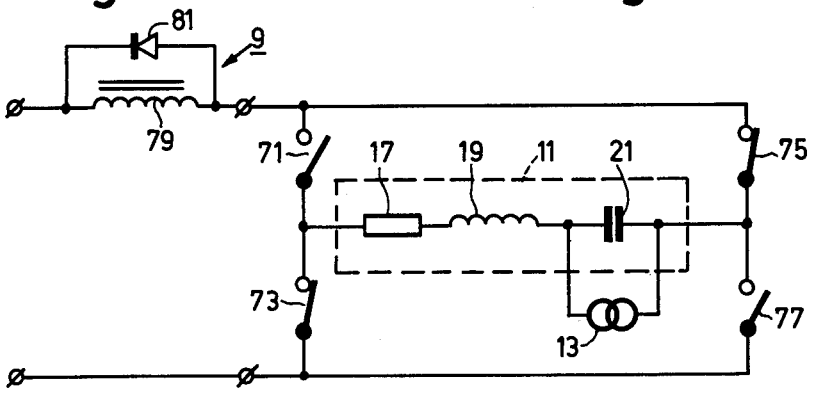

The invention will be described in detail hereinafter with reference to the accompanying diagrammatic drawing in which:

FIG. 1 shows a block diagram of an embodiment of a device in accordance with the invention, i.e. a high voltage power supply for an X-ray tube, FIG. 2 shows an equivalent diagram for a high voltage transformer used in the device shown in FIG. 1, FIG. 3 shows a voltage/time diagram to illustrate the drawbacks of the transformer shown in FIG. 2, FIGS. 4 to 6 show a number of embodiments of circuits for eliminating these drawbacks, FIG. 7 shows a voltage/time diagram for the circuits shown in the FIGS. 4 to 6, FIG. 8 shows a voltage/time diagram for a variant of the device in accordance with the invention, and FIG. 9 shows an embodiment of a circuit for realizing the voltage/time diagram shown in FIG. 8.

The reference numeral 1 in FIG. 1 denotes a rectifier which can be connected to the AC supply lines via connection terminals 3, 5 and which supplies a (preferably variable) direct voltage to a converter 7 which converts the direct voltage into a squarewave voltage having a frequency of, for example, 200 Hz. This squarewave voltage is applied, via a circuit 9 which will be described hereinafter, to the primary side of a high voltage transformer 11, the secondary side of which is connected, via a bridge rectifier 12, to an X-ray tube 13. The squarewave voltage, stepped up by the transformer 11 and rectified by the bridge rectifier 12, constitutes the high voltage for the X-ray tube 13.

FIG. 2 shows an equivalent diagram of the high voltage transformer 11 consisting of an ideal transformer 15 having a primary winding which is connected in series with the leakage inductance 19 and the ohmic resistance 17 and parallel to the parasitic capacitance 21 which mainly originates from the secondary winding. If a voltage $U_i$ (see FIG. 3) which stepwise varies from O to $U_m$ is applied to the input terminals 23 and 25 of such a circuit, the voltage $U_u$ appearing at the output terminals 29, 31 performs a damped oscillation around its ultimate value. This variation is qualitatively represented by the broken curve $U_u$ in FIG. 3. This phenomenon is due to the fact that during the charging of the capacitance 21 as a result of the charging current flowing through the leakage inductance 19, magnetic energy is stored in the leakage inductance, said energy causing additional charging of the capacitance at a later time.

It will be clear that a voltage variation in accordance with the curve $U_u$ is not acceptable in many cases. For example, a variation of this kind causes excessive voltages across the X-ray tube 13 in the circuit shown in FIG. 1 so that this tube is liable to be damaged. It is also desirable to prevent the oscillations at the output terminals 29, 31 as much as possible. This can be achieved by ensuring that no current is available for the additional charging of the parasitic capacitance. In the voltage range which includes its operating voltage, the X-ray tube 13 takes a substantially constant current which is independent of the operating voltage. As a load for the transformer 11, it therefore behaves as a current sink. When it is ensured that the current on the primary side of the transformer 11 also remains constant, no current is available for the additional charging of the parasitic capacitance and the secondary voltage remains at the desired value. In order to achieve this object, the circuit 9 is included in the connection lead on the primary side of the transformer 11.

Figure 4:
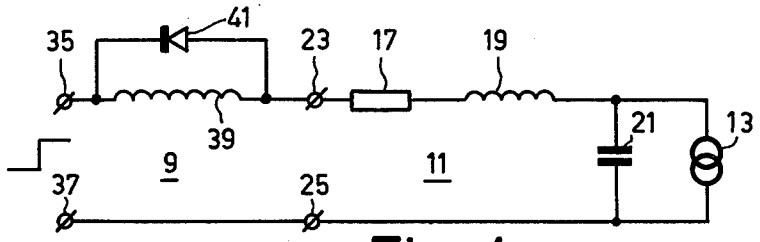

FIG. 4 shows a first embodiment of this circuit. This embodiment is particularly suitable for suppressing oscillations when the input voltage consists of a single voltage step as denoted by $U_i$ in FIG. 3. The circuit comprises input terminals 35, 37 and in this case consists of a coil 39 to which a rectifier (diode) 41 is connected in parallel so that its forward direction is oriented from the terminal 23 to the input terminal 35. When a voltage step is applied to the terminals 35, 37, the terminal 35 being positive, the diode 41 is not conductive so that all of the charging current for the capacitance 21 flows through the coil 39. The inductance of the coil 39 is substantially higher than the leakage inductance 19 (for example, 10 to 100 times higher) so that the largest part by far of the magnetic energy is stored in this coil. At the instant at which the voltage on the terminal 23 becomes higher than that on the terminal 35, the diode 41 starts to conduct so that the energy in the coil 39 can be discharged via this diode. Therefore, this energy is not available for generating oscillations. Only the energy stored in the leakage inductance 19 can contribute thereto, but this energy amounts to only a small fraction of the total magnetic energy so that no oscillations of any significance occur.

The circuit shown in FIG. 4 can be made suitable for positive as well as negative voltage steps (or for squarewave voltages) by connecting a parallel connection of a coil and a diode between the terminals 37 and 25 which is similar to that between the terminals 35 and 23. However, the circuit 9 will preferably be constructed so that all elements are included between the terminals 35 and 23. An example of a circuit in which this is realised, and which is still suitable for squarewave voltages, is shown in FIG. 5. The circuit 9 then comprises a coil 43 which is connected in series with a diode 45, and also a coil 47 which is connected in series with a diode 49. Both series networks are connected in parallel so that the diodes are connected in anti-parallel, which means that their forward directions are oppositely directed. The coils 43 and 47 are furthermore magnetically coupled to each other via a ferromagnetic core 51, the winding directions of the coils being chosen so that oppositely directed currents in the coils cause magnetic fields in the core which have the same direction. The operation of this circuit is as follows. When a squarewave voltage is applied to the terminals 35, 37, for example, the terminal 35 is initially positive. In that case the diode 45 is conductive and the capacitance 21 is charged via the coil 43. When the voltage on the terminal 23 becomes higher than that on the terminal 35, the diode 49 becomes conductive so that, due to the magnetic energy stored in the core 51, a current starts to circulate through the coils 43, 47 and the diodes 49, 45. The energy stored thus does not contribute to further charging of the capacitance 21. Because the inductance of the coils 43, 47 is again chosen to be much higher than the leakage inductance 19, no oscillations of any significance will occur.

When the voltage at the terminals 35, 37 changes its sign after some time, so that the terminal 35 becomes negative, the diode 45 is no longer conductive and the capacitance 21 is charged in the reverse direction, via the coil 47, until the voltages on the terminals 23 and 35 are equal again, after which a circulating current arises once more. This cycle is repeated during each period of the applied squarewave voltage. The foregoing demonstrates that the current direction in the two coils 43, 47 always remains the same, while the current intensity does not exhibit substantial changes. Consequently, in spite of the high inductance, the response of the circuit is adequate to conduct a squarewave voltage of a few hundreds of Hz substantially without distortion.

For the embodiment of the circuit 9 which is shown in FIG. 5, two coils 43 and 47 are required. FIG. 6 shows an embodiment which is cheaper because it comprises only one coil 53. Four diodes 55, 57, 59 and 61 are used therein, but the two additional diodes are cheaper than one coil. The four diodes are connected so that they form a bridge rectifier, the coil 53 being connected to the direct voltage connections 63, 65, while the alternating voltage connections are formed by the terminals 35 and 23 in the connection lead of the transformer 11.

When the terminal 35 is positive with respect to the terminal 23, the diodes 55 and 57 are conductive and the current flows from the connection 63, via these diodes, through the coil 53 to the connection 65. When the terminal 23 is positive with respect to the terminal 35, the two other diodes 59 and 61 are conductive, but the current direction in the coil 53 is the same. Consequently, the magnetic energy again remains stored in the coil core without becoming available for sustaining oscillations.

Depending on the values of the inductance of the coils 43, 47 or 53 ($L_1$), 19 ($L_2$), the resistance 17 (R) and the capacitance 21 (C), a complication which will be described with reference to FIG. 7 can occur in the described circuits.

Assume that at a given instant the input voltage $U_i$ (the voltage between the terminals 35 and 37, denoted by a non-interrupted curve in FIG. 7) as well as the output voltage $U_u$ (the voltage across the tube 13, denoted by a broken line in FIG. 7) equals $-U_m$. At the instant $t_1$, $U_i$ becomes $+U_m$. Due to the capacitance C of the capacitor 21, $U_u$ will follow this step after some delay and will become equal to $+U_m$ only at the instant $t_2$. Therefore, during some time after $t_1$ a voltage $U_m - U_u$ is present across the series connection of $L_1$ and $L_2$, so that a current I is built up in $L_1$ and $L_2$. This current is proportional to the shaded area 67 of FIG. 7 because:

$$I = \frac{1}{L_1 + L_2} \int_{t_1}^{t_2} (U_m - U_u)dt \qquad (1)$$

As from the instant $t_2$, this current starts to circulate through the coil 53 and the diode bridge. When the voltage $U_i$ is changed over again from $+U_m$ to $-U_m$, the same thing takes place so that the circulating current continuously increases. Ultimately, a state of equilibrium is reached where the current increase for each change-over equals the current decrease between two change-overs. This current decrease $\Delta I$ is determined by the voltage $U_L$ across $L_1$ in accordance with the formula:

$$\Delta I = \frac{1}{L_1} \int_{O}^{\frac{1}{2}T} U_L dt \qquad (2)$$

Therein, T is the period of the squarewave input voltage $U_i$.

It has been found in practice that the circulating current may be many times larger than the current taken up by the tube 13. In that case, $L_1$ no longer acts as a current source equalling the load current so that the useful effect of the circuit 9 is at least partly lost. It will be obvious that the circulating current can be reduced by reducing I or by increasing $\Delta I$. It appears from (2) that the latter can be achieved by increasing $U_L$, that is to say by connecting, parallel to the coil 53, a number of diodes in series or a diode with a series resistor. However, this gives rise to unacceptable losses in many cases. A better solution consists in the reduction of I. This will be described in detail with reference to FIG. 8.

According to this method, $U_i$ is not directly switched over from $-U_m$ to $+U_m$, but rather from $-U_m$ to zero. At the same time, the input of the transformer is short-circuited. R, $L_2$ and C then form a parallel oscillator circuit. The voltage $U_u$ across C will change sinusoidally from $-U_m$ to a value $+U_c$ which is slightly lower than $+U_m$. The difference between $U_m$ and $U_c$ depends on the quality Q of the oscillator circuit. At the instant $t_3$, the maximum value $+U_C$ is reached and the short-circuit is removed, the input voltage $U_i$ being at the same time increased from zero to $+U_m$. Consequently, the output voltage also becomes $+U_m$ after some delay, a current I' being again built up in $L_1$. However, this current is now proportional to the shaded area 69 in FIG. 8, i.e. substantially smaller than the current I in accordance with (1). It will be obvious that the described method has the desired effect only if the quality Q of the oscillator circuit is high enough (substantially higher than 1). It has been found in practice, however, that exactly in the cases where the drawback described with reference to FIG. 7 is most significant, Q is also comparatively high, so that the described method indeed offers a substantial improvement.

FIG. 9 shows an embodiment of a circuit whereby the method described with reference to FIG. 8 can be performed. The converter 7 (see FIG. 1) generally comprises four switches 71, 73, 75, 77 (for example, thyristors) which are opened and closed in a sequence which is controlled by a control unit in order to convert the direct voltage of the rectifier 1 into a squarewave voltage. The control unit is not shown in FIG. 9 for simplicity of the drawing. Furthermore, in FIG. 9 the circuit 9 is arranged in front of the converter instead of behind the converter. This is not of essential importance for performing the method of FIG. 8, but offers the advantage that one coil 79 and one diode 81 suffice.

The operation is as follows. Assume that the switches 73 and 75 are closed (the condition shown in FIG. 9). At the instant $t_1$ (FIG. 8), the switch 75 is opened and the switch 77 is closed. The transformer 11 is then short-circuited. The load current flowing through the coil 79 then starts to circulate through the coil 79 and the diode 81 so that the voltage across the coil 79 amounts to approximately O. At the instant $t_3$, the switch 73 is opened and the switch 71 is closed with the result that the input voltage will be present across the transformer in the reversed condition, the capacitance 21 being charged further to the input voltage.

What is claimed is:

1. A device for suppressing oscillations in a transformer comprising, a pair of input terminals for connection to a source of stepwise varying voltage, a transformer having a primary winding for coupling to said input terminals and a secondary winding for coupling to a load, said transformer exhibiting a leakage inductance and a parasitic capacitance of a value to produce oscillations in the secondary winding in response to a stepwise voltage applied to the primary winding, a circuit having first and second connection terminals, means connecting said circuit in series with said primary winding across the input terminals, said circuit including inductance means and rectifier means connected together so that the current through the inductance means does not reverse its direction of flow when the polarity of the voltage across the first and second connection terminals of said circuit is reversed, the inductance of said inductance means being at least 10 times larger than the leakage inductance of the transformer.

2. A device as claimed in claim 1 wherein the rectifier means in the circuit is connected so as to allow the circuit to conduct a current substantially equally well in both directions.

3. A device as claimed in claim 1 wherein the circuit rectifier means includes two diodes and the inductance means includes a parallel connection of two coils connected in series with a respective one of the diodes and with the diodes connected in antiparallel, the coils being magnetically coupled to each other and being wound so that oppositely directed currents cause magnetic fields oriented in the same direction, whereby the circuit conducts current substantially equally well in both directions.

4. A device as claimed in claim 1 wherein the circuit rectifier means comprises a rectifier circuit of the bridge type having a pair of direct voltage terminals and a pair of alternating voltage terminals, the inductance means comprising a coil connected to the direct voltage terminals of the bridge rectifier circuit, said circuit being connected to the primary winding of the transformer via the alternating voltage terminals of the bridge rectifier circuit, whereby the circuit conducts current substantially equally well in both directions.

5. A device as claimed in claim 1 wherein the device further comprises a converter for generating a squarewave voltage having a frequency of some hundreds of Hz connected in cascade with said circuit.

6. A device as claimed in claim 5, wherein the device is constructed as a high voltage generator for an X-ray tube load.

7. A device as claimed in claim 1 wherein said inductance means and said rectifying means comprise a coil and a diode, respectively, connected in parallel between said first and second connection terminals.

8. A device as claimed in claim 1 wherein the inductance means includes first and second coils magneticially coupled to each other and the rectifying means includes first and second diodes, the first coil and the first diode being serially connected between said first and second connection terminals and the second coil and the second diode being serially connected between said first and second connection terminals and in parallel with the serial connection of the first coil and first diode and with the first and second diodes oppositely poled with respect to said first and second connection terminals.

9. A device for suppressing oscillations in a transformer comprising, a pair of input terminals for connection to a source of stepwise varying voltage, a transformer having a primary winding for coupling to said input terminals and a secondary winding for coupling to a load, said transformer exhibiting a leakage inductance and a parasitic capacitance of a value to produce oscillations in the secondary winding in response to a stepwise voltage applied to the primary winding, a circuit having first and second connection terminals, means connecting said circuit in series with said primary winding across the input terminals, said circuit including inductance means and rectifier means connected together so that the current through the inductance means does not reverse its direction of flow when the polarity of the voltage across the first and second connection terminals of said circuit is reversed, the inductance of said inductance means providing an inductive impedance substantially independent of the value of the load current and being substantially larger than the leakage inductance of the transformer.

10. A device as claimed in claim 9 wherein the inductance of said inductance means is approximately 10 times to 100 times larger than the transformer leakage inductance.

* * * * *